US010654297B2

(12) United States Patent
Wind et al.

(10) Patent No.: US 10,654,297 B2
(45) Date of Patent: May 19, 2020

(54) LOADING TOOL FOR LOADING NEW WEB MEDIA IN A ROLL PRINTING SYSTEM

(71) Applicant: Océ Holding B.V., Venlo (NL)

(72) Inventors: Anne A. Wind, Venlo (NL); Marcus H. G. W. Hees, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/425,106

(22) Filed: May 29, 2019

(65) Prior Publication Data

US 2019/0375219 A1 Dec. 12, 2019

(30) Foreign Application Priority Data

Jun. 12, 2018 (EP) ..... 18177230

(51) Int. Cl.
*B41J 15/04* (2006.01)
*B41J 15/16* (2006.01)

(52) U.S. Cl.
CPC ..... *B41J 15/042* (2013.01); *B41J 15/16* (2013.01); *B65H 2301/44* (2013.01); *B65H 2404/1431* (2013.01)

(58) Field of Classification Search
CPC . B41J 15/042; B41J 15/16; B65H 2404/1431; B65H 2301/44; B65H 19/105; B65H 2801/15; B65H 2801/06; B65H 2407/21; B65H 2404/65; B65H 2404/531; B65H 2402/31; B65H 2301/52202; B65H 2301/415095
See application file for complete search history.

(56) References Cited

U.S. PATENT DOCUMENTS

| | | | | |
|---|---|---|---|---|
| 5,951,181 | A | 9/1999 | Hierro et al. | |
| 5,988,903 | A | 11/1999 | Baitz et al. | |
| 2010/0066008 | A1* | 3/2010 | Hoover | B65H 1/14 271/162 |

(Continued)

FOREIGN PATENT DOCUMENTS

| | | | |
|---|---|---|---|
| EP | 3 305 695 | A1 | 4/2018 |
| JP | 59-172348 | A | 9/1984 |
| JP | 2000-191194 | A | 7/2000 |

OTHER PUBLICATIONS

Search Report issued in European priority application 18177230, dated Nov. 21, 2018.

*Primary Examiner* — Henok D Legesse
(74) *Attorney, Agent, or Firm* — Birch, Stewart, Kolasch & Birch, LLP

(57) ABSTRACT

A web printing system has a loading tool to aid in the loading of new wide format web media. The loading tool is pivotable between a first position for loading a leading edge portion of the web onto the loading tool and a second position wherein an end portion of the loading tool extends above a print surface when in use. The end portion of the loading tool includes a beam element protruding from the loading tool in its pivoting direction towards the print surface, wherein in the second position the beam element is positioned with respect to the turn element, such that an S-shaped curve is formed in a web held on the loading tool. The curvature in the web significantly enhances the friction exerted by the beam element on the web, thereby stably holding the web in place.

18 Claims, 4 Drawing Sheets

(56) References Cited

U.S. PATENT DOCUMENTS

| | | | | |
|---|---|---|---|---|
| 2016/0136981 | A1* | 5/2016 | Suzuki | B41J 11/70 347/104 |
| 2017/0275119 | A1* | 9/2017 | Hamano | B41J 2/01 |
| 2019/0100393 | A1* | 4/2019 | Shiozawa | B65H 3/0669 |

* cited by examiner

LOADING TOOL FOR LOADING NEW WEB MEDIA IN A ROLL PRINTING SYSTEM

FIELD OF THE INVENTION

The present invention generally pertains to a web printing system and a loading tool for loading a new web into a web printing system.

BACKGROUND ART

In wide format web printing systems, web media are generally supply from rolls of wound up print medium, such as paper, foil, or textile. Loading a new web into a printing system is generally a cumbersome operation since the width of such webs can in practice exceed three meters, making it difficult to handle such webs. Web loading aids are known, e.g. from EP3305695 A1, which discloses a loading arm for pivoting a leading edge of a new web upwards to a print surface. The web is therein held onto the arm by suction or by a clamp. Further, semi-automated solutions are known wherein the web is transported by transport pinches after having been brought into engagement with said pinches by means of a loading arm. A disadvantage of the above mentioned prior art devices are the relative complexity and high costs of the device and/or their insuitability for various web media types: not all print media are suited for clamping or transportation by transport pinches.

SUMMARY OF THE INVENTION

It is thus an object of the present invention to provide a simple and versatile web media loading tool for use in roll printing systems.

In an aspect of the present invention, a web printing system according to claim 1 is provided. The web printing system comprises:

- an input roller for supplying a web of print medium along a transport path to a print surface positioned higher than the input roller when in use;
- a turn element positioned between the input roller and the print surface the turn element defining a curve in the transport path;
- a loading tool pivotable between a first position for loading a leading edge portion of the web onto the loading tool and a second position wherein an end portion of the loading tool extends above the turn element when in use, the loading tool comprising: an arm pivotably mounted on a frame of the printing system and wherein the end portion of the loading tool comprises a beam element protruding from the arm in a pivoting direction towards the print surface, wherein in the second position the beam element is positioned with respect to the turn element, such that an S-shaped curve is formed in the web held on the loading tool directing a portion of the web underneath the beam element.

It is an insight of the inventors that a loading tool which holds the web in place by friction forces provides a simple and versatile web loading device. No deformation of the media is then required for holding the web in place on the loading tool. It is a further insight of the inventors that the S-shaped curve in the web establishes a curvature in the portion of the web lying over the beam element, which curvature significantly enhances the friction forces between the web and the beam element. This allows the web, when draped over the loading tool, to be stably held on the loading tool even though the weight of the portions of the web on opposite sides of the loading differ significantly. No forces aside from gravity are required to obtain the required frictional holding forces. Such a frictional loading tool is versatile as it may also handle fragile or porous media unsuited for clamping or suction-based holding. The S-shaped curve ensures the holding is sufficiently stabile to achieve easy loading of a wide variety of media. As such a simple and versatile loading is provided. Thereby the object of the present invention has been achieved.

In an embodiment, the beam element in the second position protrudes such that a portion of the web when positioned on the loading tool curves from a top surface of the beam element, around a side of the beam element, to underneath the beam element. The web lies over the beam element and then curves around a lateral side of the beam element facing the print surface to underneath the beam element. The respective lateral side of the beam element is, preferably at least partially, positioned within the respective curved portion of the web. The S-shaped curve is formed by the turn element collaborating with the beam element to curve the web around the beam element. One end of the S extends upwards along the respective side of the beam element, while the other end of the S-shape extends downwards along the turn element. It will be appreciated that S-shaped herein is preferably defined as any manner of curve substantially shaped as a sigmoid function as commonly known in mathematics. The S-shape may be symmetric or asymmetric and other commonly mathematical functions similar to the sigmoid function may be used to describe the S-shape, such as arctan or erf functions.

In another embodiment, the beam element is configured such that the web when positioned or draped over the beam element in the second position further comprises a reversed U-shaped curve, wherein legs of the U-shape extend on opposing sides of the beam element. The beam element is substantially positioned within the U-shaped curve, when the web is draped over the beam element. The U-shape may include a classic U, V, parabola, or other similar two-legged shape. It will be appreciated that the legs of the U-shape within the present invention need not be fully parallel. In the second position the turn element is positioned partially underneath the beam element, such that when pivoting to the second position the stationary turn element guides a portion of the web underneath the beam element. Without the turn element, the web would hang downward on both sides of the loading tool in roughly a U-shape. When pivoting the leg of the U-shape facing the frame comes into contact with the turn element. This leg is deformed as the lower portion is prevented from moving in the pivoting direction, whereas a higher portion of the leg is moved by the side of the beam element in the pivoting direction over the turn element. This relative, opposite movement of the lower and higher portions of the leg results in the S-shape. Preferably the turn element comprises a curved surface curving over an angle of at least 90°.

In a further embodiment, a leg of the U-shaped on a side of a frame of the printing system extends into the S-shaped curve. The respective leg extends downwards along the respective side of the beam element. The lower end of the leg extends downwards towards the turn element. The turn element guides the web underneath the beam element by preventing a portion of the web from moving in the pivoting direction while an above lying portion of the web moves in the pivoting direction over the turn element.

In an embodiment, the end portion is an L-shaped portion configured such that in the second position a leg of the L-shaped portion extends above and at least partially over the turn element. Thereby a passage or gap is formed between the turn element and the beam element. A web draped over the beam element and extending downward from a top side of the beam element on the side of the turn element is guided by the turn element towards the arm of the loading tool. Thereby, the web curves around and underneath the beam element. In the second position the turn element is at least partially positioned within the corner defined by the L-shaped.

In another embodiment, the end portion comprises a first curved section defining an at least semi-circle bend in the web loaded on the loading tool in the second position and a second curved second section positioned opposite to the first curved section in the pivoting direction and defining an at least quarter circle bend in the web loaded on the loading tool in the second position. Friction can be enhanced further by improving contact the web and the beam element. The first and second curved sections are thus curved such that the portions of the web positioned over the curved sections closely follow the curvature of the curved sections. The radius of curvature of the first and second curved section is thus sufficiently large to prevent folding or wrinkling and ensures smooth curves the web. Together the first and second curved section ensures that the web curves around the beam element over an angle of at least 180°, preferably at least 200°, very preferably 230°, and even more preferably at least 270°. As will be explained in more detail with respect to FIG. 4, this angle greatly increases the frictional forces between the web and the beam element, ensuring a stable holding of the web during loading.

In a further embodiment, the first and second curved sections are provided with a high friction surface having a coefficient of friction greater than that of the turn element. The high friction surface may be formed of rubber or a surface-treated plastic to improve its coefficient of friction. As such frictional holding between the web and the beam element may be improved further.

In an embodiment, the loading tool is positioned on an opposite side of the transport path than the frame. The transport path extends between the frame and the arm of the loading tool. The loading tool is thereby easily accessible to the operator during loading operations.

In another embodiment, the arm of the loading tool in the second position extends substantially parallel to the adjacent transport path. The arm extends parallel to the section of the web between the input roller and the turn element during printing operations. Preferably the web and the arm in the second position extend substantially vertically. The total volume occupied by the printing system during operations is thereby reduced.

In an further embodiment, the printing system according to the present invention further comprises a closing sensor configured to determine whether the loading tool is in the second position and a controller to prevent printing when the closing sensor determines the loading tool is absent from the second position. The closing sensor may be a contact switch or any other suitable position detector. The controller is configured to prevent printing operations without appropriate input from the closing sensor to confirm the loading tool is in the second position.

In an embodiment, beam element is a longitudinal beam element and the arm is attached to beam element near or at a side of the beam element facing away from the print surface. The majority of the beam element thus protrudes away from the arm on the side of the frame.

In a further embodiment, the end portion is formed to in the second position to collaborate with the turn element to curve the web around the beam element over an angle of substantially 180, preferably at least 200°, very preferably at least 230°, and even more preferably 270° or more. The web curves around the beam element over said angle. The curvature forming the angle need not be continuous as long as long as the total curve of the web around the beam element exceeds 180°, preferably at least 200°, very preferably at least 230°, and even more preferably 270°. As will be explained with regard to FIG. 4, the angle is exponentially proportional to the friction forces, which help form a simple yet stabile loading tool.

In a further aspect, the present invention provides a loading tool for use in the printing system according to any of the present invention, the loading tool comprising an arm pivotable around a pivot axis and having an L-shaped end portion comprising a beam element protruding from the arm, the beam element comprising a first curved section for defining an at least semi-circle bend in a web loaded on the loading tool in the second position and a second curved second section positioned opposite to the first curved section defining an at least quarter circle bend in the web loaded on the loading tool in the second position. The loading tool may be configured as described in any of the embodiments mentioned above.

In another aspect, the present invention provides a method for loading a new web in a web printing system, the method comprising the steps of:

draping a leading edge section of a web over a pivotable loading tool in a first position near an input roller, the loading tool comprising an arm and an L-shaped end portion;

pivoting the loading tool towards a turn element adjacent a print surface to a second position, wherein the end portion is positioned at least partially over the turn element, such that an S-shaped curve is formed in the web between the end portion and the turn element.

The turn element is positioned such that it prevents a portion of the web from moving in the pivoting direction as the end portion with the web on it moves over the turn element in the pivoting direction. Thereby, an S-shaped curve is formed in the web, which curve greatly improves the frictional holding of the loading tool on the web. As the web is then stably and securely held by friction, the operator is free to move around the frame to the output for threading the leading edge over the print surface towards the output roller.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1A:
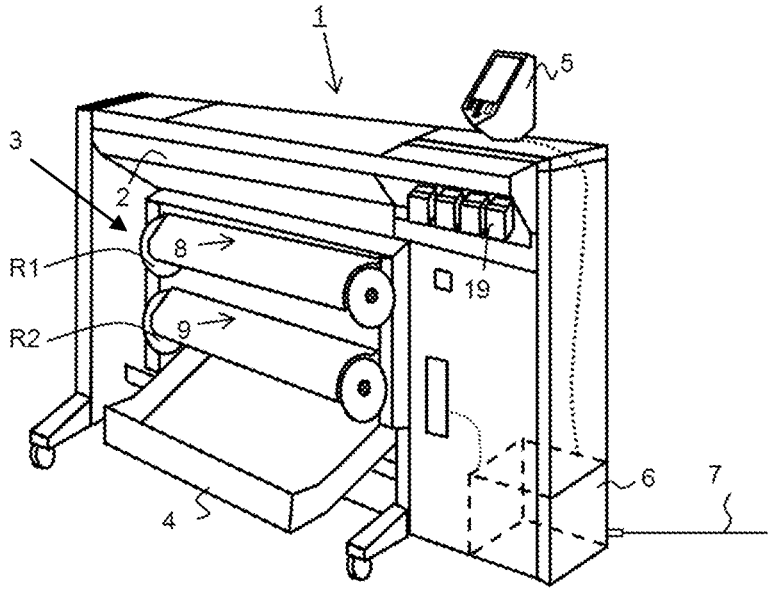
FIG. 1A shows a schematic perspective view of a web printing system.

The present invention will now be described with reference to the accompanying drawings, wherein the same reference numerals have been used to identify the same or similar elements throughout the several views.

Printing System

FIG. 1A shows an image forming apparatus 1, wherein printing is achieved using a wide format inkjet printer. The wide-format image forming apparatus 1 comprises a housing 2 holding the printing assembly 10. The image forming apparatus 1 also comprises at least one media input unit 3 for storing one or more media 8, 9 in the form of a wound-up roll of web medium. The media 8, 9 are supplied by a roll 8, 9. The roll 8 is supported on the roll support R1, while the roll 9 is supported on the roll support R2. A transport path extends from the media input unit 3 along the printing assembly 10 to a receiving unit 4 to collect the medium 8, 9 after printing. A storage unit 19 for marking material is provided to hold marking materials. Each marking material for use in the printing assembly 10 is stored in one of a plurality of containers 19 arranged in fluid connection with the respective print heads for supplying marking material to said print heads to print an image on the medium 8, 9. The receiving unit 4 may comprise a take-up roller for winding up the printed medium 8, 9 or a receiving tray for supporting sheets of printed medium 8, 9. Optionally, the receiving unit 4 may comprise processing means for processing the medium 8, 9 after printing, e.g. a post-treatment device such as a coater, a folder or a puncher. The wide-format image forming apparatus 1 furthermore comprises a user interface 5 for receiving print jobs and optionally for manipulating print jobs. The local user interface unit 5 is integrated to the print engine and may comprise a display unit and a control panel. Alternatively, the control panel may be integrated in the display unit, for example in the form of a touch-screen control panel. The local user interface unit 5 is connected to a control unit 6 connected to the image forming apparatus 1. The control unit 6, for example a computer, comprises a processor adapted to issue commands to the image forming apparatus 1, for example for controlling the print process. The image forming apparatus 1 may optionally be connected to a network N. The connection to the network N is diagrammatically shown in the form of a cable 7, but nevertheless, the connection could be wireless. The image forming apparatus 1 may receive printing jobs via the network N. Further, optionally, the control unit 6 of the image forming apparatus 1 may be provided with a USB port, so printing jobs may be sent to the image forming apparatus 1 via this USB port.

Printing Assembly

Figure 1B:
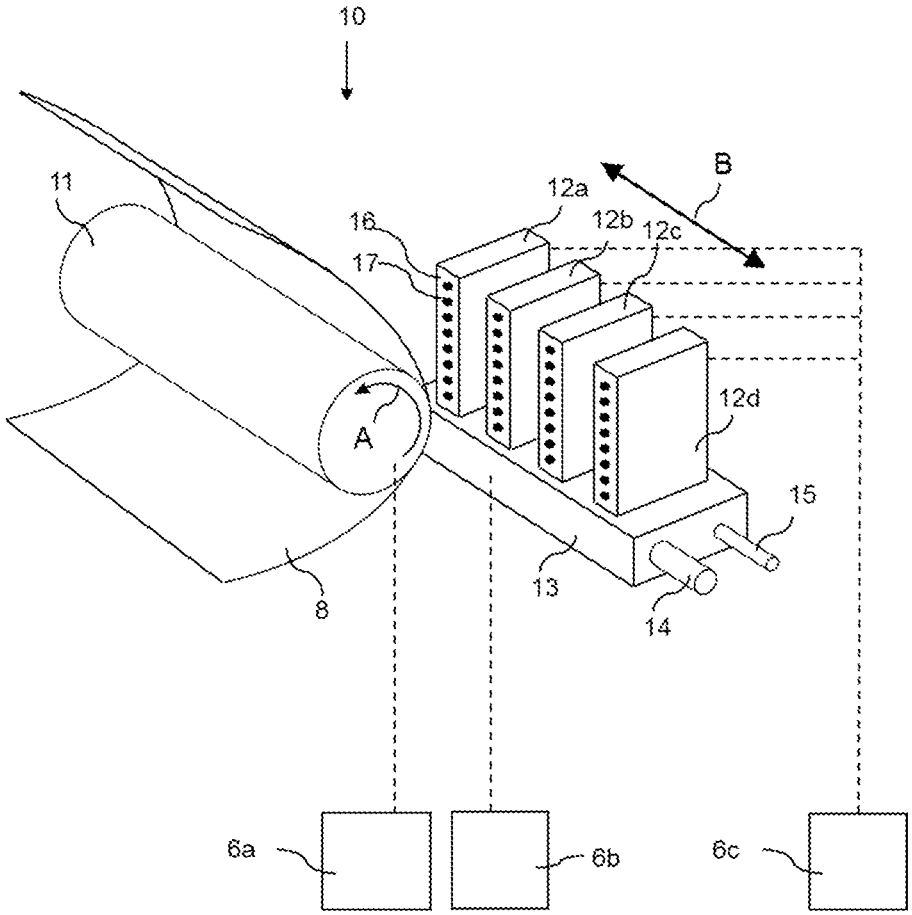
FIG. 1B shows a schematic perspective view of the inkjet printing assembly of the web printing system in FIG. 1A.

FIG. 1B shows an ink jet printing assembly 10. The ink jet printing assembly 10 comprises a medium support surface to support the medium 8, 9 during printing. The medium support surface in FIG. 1B is provided on a platen 11 in the form of a drum rotatable in direction A, but may, alternatively, be a flat support surface. The medium support surface is preferably provided with suction holes for at least temporarily holding the medium 8, 9 in a fixed position with respect to the medium support surface. The ink jet printing assembly 10 comprises print heads 12*a*-12*d*, mounted on a scanning print carriage 13, or alternatively as a stationary page-wide array. The scanning print carriage 13 is guided by suitable guides 14, 15 to move in reciprocation in the main scanning direction B. Each print head 12*a*-12*d* comprises an orifice surface 16, which orifice surface 16 is provided with at least one orifice 17. The print heads 12*a*-12*d* are configured to eject droplets of marking material onto the medium 8, 9. The medium support surface, the carriage 13 and the print heads 12*a*-12*d* are controlled by suitable controlling means 6*a*, 6*b* and 6*c*, respectively.

The medium 8, 9 is supplied in web form and may be composed of e.g. paper, cardboard, label stock, coated paper, plastic or textile. The medium 8, 9 is moved in the sub-scanning direction A by the platen 11 along four print heads 4*a*-4*d* provided with a fluid marking material.

A scanning print carriage 13 carries the four print heads 12*a*-12*d* and may be moved in reciprocation in the main scanning direction B parallel to the medium support surface, such as to enable scanning of the medium 8, 9 in the main scanning direction B. Any number of print heads may be employed. Preferably, at least one print head 12*a*-12*d* per color of marking material is placed on the scanning print carriage 13, for example one for print head 12*a*-12*d* for each of the applied colors, usually black, cyan, magenta and yellow is present. Often, in a full-color printer, black marking material is used more frequently in comparison to differently colored marking material. Therefore, more print heads 12*a*-12*d* containing black marking material may be provided on the scanning print carriage 13 compared to print heads 12*a*-12*d* containing marking material in any of the other colors. Alternatively, the print head 12*a*-12*d* containing black marking material may be larger than any of the print heads 12*a*-12*d*, containing a differently colored marking material.

The carriage 13 is guided by guides 14, 15 in the form of guide rails or rods 14, 15, as depicted in FIG. 1B. The carriage 13 may be driven along the guides 14, 15 by a suitable driving actuator (not shown). An alternative is to move the medium 8, 9 in the main scanning direction B.

Print Heads

Each print head 12*a*-12*d* comprises an orifice surface 16 having at least one orifice 17, in fluid communication with a pressure chamber containing fluid marking material provided in the print head 12*a*-12*d*. On the orifice surface 16, a number of orifices 17 is arranged in a single linear array parallel to the sub-scanning direction A. Eight orifices 17 per print head 12*a*-12*d* are depicted in FIG. 1B, however obviously in a practical embodiment at least several hundreds of orifices 17 may be provided per print head 12*a*-12*d*, optionally arranged in multiple arrays. As depicted in FIG. 1B, the respective print heads 12*a*-12*d* are placed parallel to each other such that corresponding orifices 17 of the respective print heads 12*a*-12*d* are positioned in-line in the main scanning direction B. This means that a line of image dots in the main scanning direction B may be formed by selectively activating up to four orifices 17, each of them being part of a different print head 12*a*-12*d*. This parallel positioning of the print heads 12*a*-12*d* with corresponding in-line placement of the orifices 17 is advantageous to increase productivity and/or improve print quality. Alternatively multiple print heads 12*a*-12*d* may be placed on the print carriage adjacent to each other such that the orifices 17 of the respective print heads 12*a*-12*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 17.

Upon ejection of the marking material, some marking material may be spilled and stay on the orifice surface 16 of the print head 12*a*-12*d*. The ink present on the orifice surface 16, may negatively influence the ejection of droplets and the placement of these droplets on the medium 8, 9. Therefore, it may be advantageous to remove excess of ink from the orifice surface 16. The excess of ink may be removed for example by wiping with a wiper and/or by application of a suitable anti-wetting property of the surface, e.g. provided by a coating.

Figure 2A:
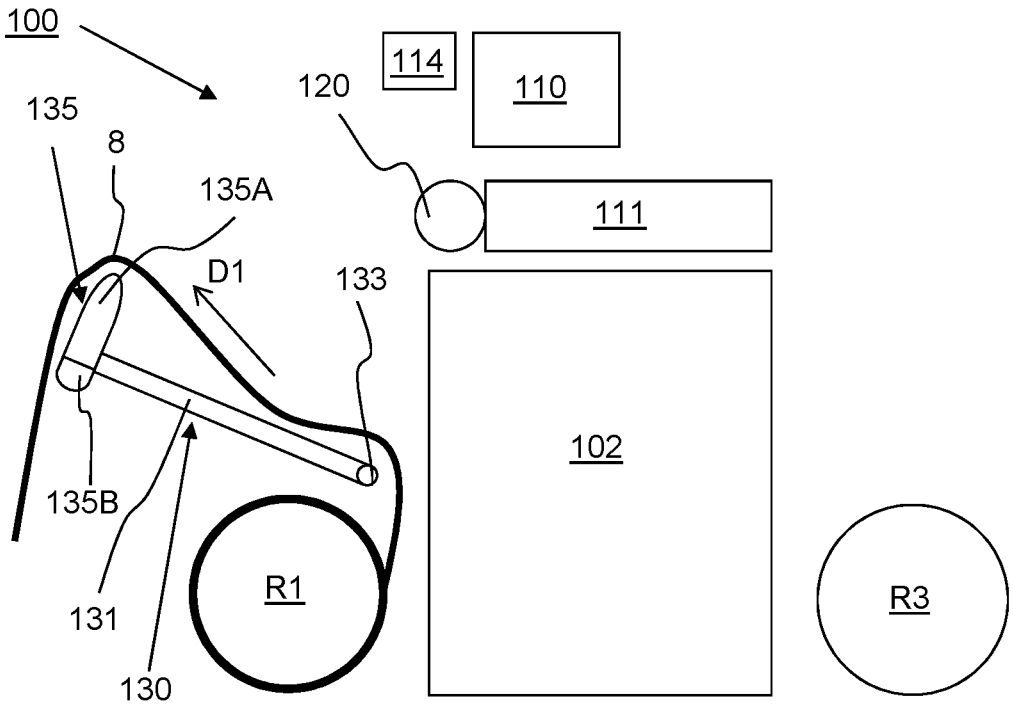
FIGS. 2A-C show schematical side views of an embodiment of a printing system according to the present invention in different stages of loading a new web.

FIG. 2A shows an embodiment of a printing system 100 according to the present invention. The printing system 100 in FIG. 2 is a roll-to-roll printing system 100, though the present invention may be applied in any type of roll printing system, such as the one described with respect to FIG. 1A. It will be clear to the skilled person that any relevant features of FIGS. 1A and 1B may be included in the printing system 100 in FIG. 2A.

The printing system 100 comprising an input roller R1 which is configured to hold and rotate a roll of wound web medium 8. On an opposite side of the frame 102 of the printing system 100 an output roller R3 is provided for receiving and winding up the web 8 supplied from the input roller R1. Generally, the input and output rollers R1, R3 are provided near the bottom side of the frame 102 or the floor the printing system 100 is positioned on, as these web medium rolls are generally heavy and difficult to handle. In practice, the width of such web medium rolls may exceed 3 meter and their weight may be over a 100 kg.

From the input roller R1 the web 8 is transported upwards along a transport path to a higher lying printing surface 111. A bend or curve in the transport path is provided by the turn element 120 which turns the web from a substantially upward direction onto the horizontal plane. The turn element 120 preferably comprises a low friction surface to prevent the turn element 120 from introduces additional tension in the web 8. To ensure a gradual turn in the web 8 the turn element 120 is provided with a curved outer surface. Preferably, the surface of the turn element 120 is configured to exert little friction on the web 8 during printing operations.

Above the horizontal print surface 111 the inkjet print head assembly 110 is provided. The carriage with the printheads is moveable along the support beam 114 to swath-wise print images on the web 8.

When an input roll is replaced, the leading edge of the new web 8 needs to be fed to the output roller R3 via the transport path. Especially when the web 8 is wide (e.g. 2 meters or more) it becomes difficult to transport the web upwards from the input roller R1 to the print surface 111. Preferably contact between the web 8 and the floor is avoided to avoid contaminating the web 8. The web 8 should further not become damaged during the feeding of the leading edge. The variety in different media types for the applicable webs is generally wide and includes paper, canvas, foil, textile, etc. The properties of these media types (rigidity, elasticity, tearability, etc.) also vary greatly and each media type has to be handled in accordance with its specific properties to avoid damage, especially in case the price-per-meter of said media type is relatively large. Waste of media is then preferably avoided. Certain media require careful handling to avoid damaging or deforming the medium. Aside from the obvious tearing and wrinkling, also normally temporary indentations of certain media may become "frozen" into the medium by the printing and drying of the ink. Clamping and folding is thus preferably avoided in those cases.

To assist the operator in feeding the new web 8, the printing system 100 according to the present invention includes a loading tool 130. The loading tool 130 comprises an arm 131 which is pivotably connected to the frame 102, such that the arm 131 is pivotable around the pivot axis 133. The web transport path extends substantially upwards between the pivot axis 133 and the frame 102. The loading tool 130 is thereby easily accessible to the operator. The loading tool 130 in FIG. 2A further comprises an L-shaped end portion 135 mounted at the free end of the arm 133. The end portion 135 is formed by a beam element 135 which extends beyond the arm 133 in a direction perpendicular to the length of the arm 133. Basically a width of the portion 135 greatly exceeds the width of the arm 133.

In FIG. 2A the loading tool 130 is positioned in the first or loading position. The loading tool 130 is tilted away from the frame 102 towards the operator when loading a new web 8. The pivot axis 133 is positioned higher than the rotation axis of the input roller R1 and between said rotation axis and the frame 102 when viewed from above. The beam element 135 is mounted at the free end of the arm 131 and extends substantially perpendicular to the arm 131. The beam element 135 extends substantially in the pivoting direction (PD in FIG. 2B). The beam element 135 and the arm 131 form an L-shaped segment, the inner corner of which faces the turn element 120.

In the first position in FIG. 2A, the operator is able to access the leading edge of a new web 8 on the input roller R1. A shown in FIG. 2A, the leading edge is pulled in the direction D1 over the loading tool 130, such that a part of the web 8 extends beyond the beam element 135. The web 8 is draped over the loading tool 130 with the leading edge hanging freely of the side of the loading tool 130 remote from the frame 102. The leading edge of the web 8 is positioned below the beam element 135.

Figure 2B:
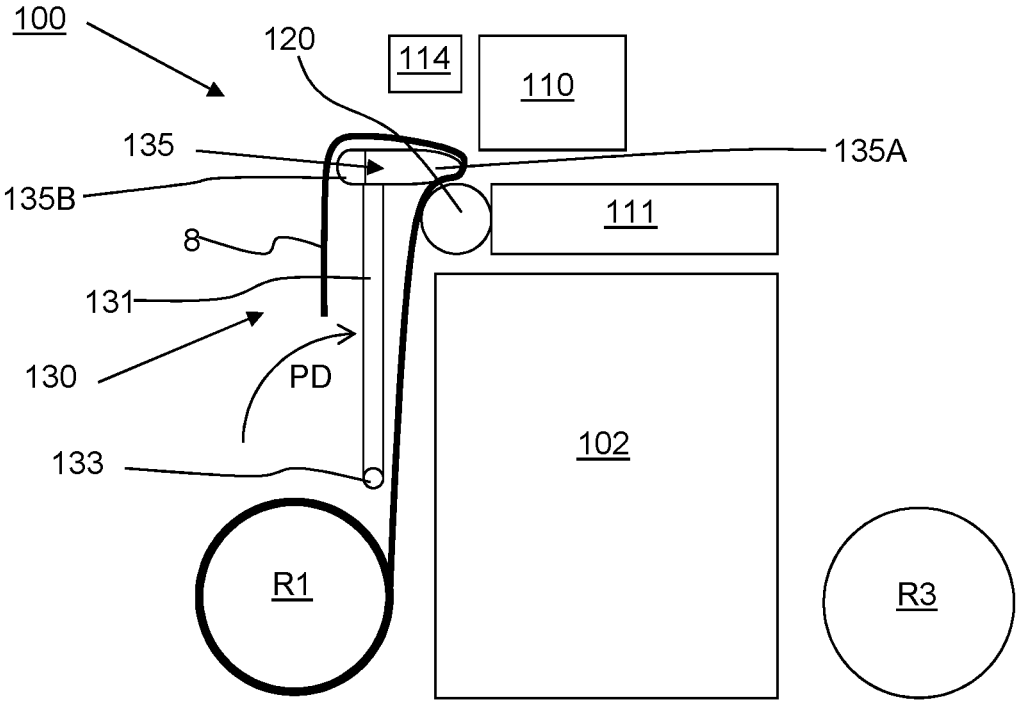

The loading tool 130 is then pivoted to the second position, as shown in FIG. 2B. The loading tool 130 pivots around the pivot axis 133 in the direction PD until the beam element 135 is positioned adjacent the turn element 120. In that position the beam element 135 extends at least partially above and over the turn element 120. The turn element 120 is thereby partially encompassed in the corner of the L-shaped end portion. By pivoting the loading tool 130 the web 8 is brought up to the print surface 111. As will be shown in more detail in FIG. 3, the loading tool 130, specifically the beam element 135, is spaced apart from the turn element 120 in the second position. By bringing the loading tool 130 to the second position, the web 8 curves in a roughly 270° turn around the beam element 135. During pivoting the web 8 hangs downward on either side of the beam element 135. When the front side of the beam element 135 which front side faces the print surface 111 moves over the turn element 120, a portion of the web 8 below the beam element 135 contacts the turn element 120. This portion is thereby prevented from moving further in the pivoting direction PD. The higher lying portion of the web 8 on curving around the front side of the beam element 135 continues to move in the pivoting direction PD. Thereby, an S-shaped curve or bend is formed in the web 8 between the turn element 135 and the front side of the beam element 135. The web 8 thus curves around the beam element 135. This curvature in the web 8 ensures large frictional forces are exerted by the beam element 135 on the web 8 to balance the web 8 on the loading tool 130, as will be explained in more detail with respect to FIG. 4. The friction forces allow the web to hang in a stabilized manner though the free end portion of the web 8 on one side of the loading tool 130 is significantly smaller than the portion of the web 8 hanging from the loading tool 130 on the side of the frame 102. The friction exerted by the beam element 135 negates the excess pulling force from the larger web portion on the frame side of the loading tool 130. As such, the web 8 is held in place substantially regardless of the length of the dangling leading edge portion.

Figure 2C:
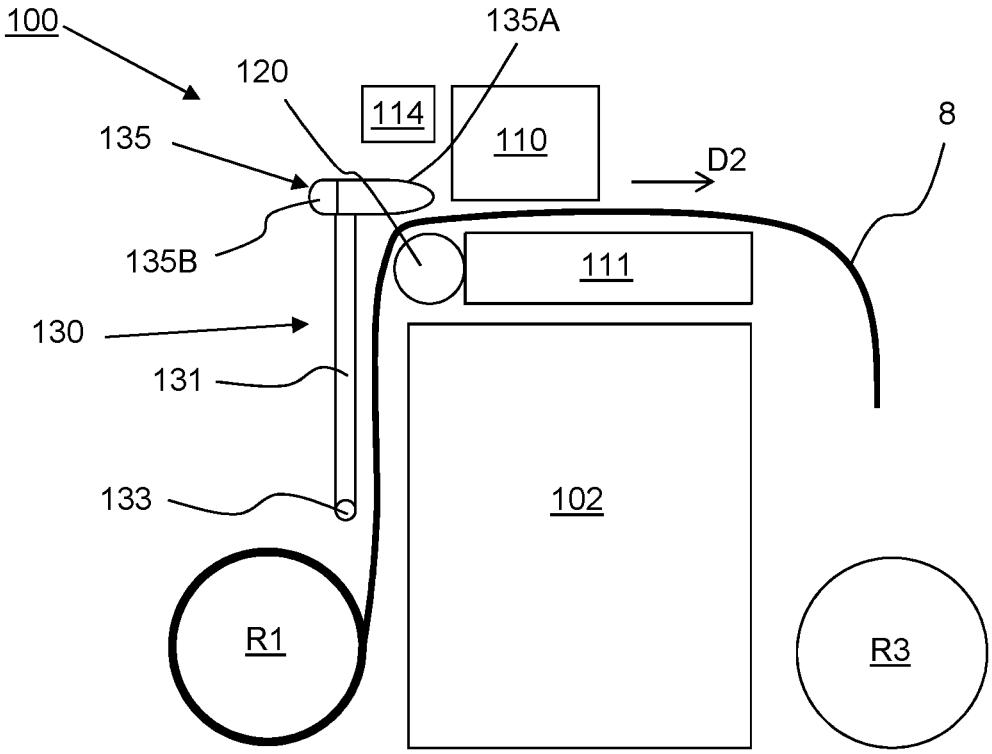

In FIG. 2C, the leading edge of the web 8 is pulled through across the print surface 111 towards the output roller R3. The operator is free to move around the printing system 100, as the web 8 is held in place by the loading tool 130. This allows web 8 to be easily threaded towards the output roller R3 and attached thereto. Recesses may be provided in the beam element 135, specifically in the first curved section 135A to allow the operator to easily access the web 8. The recesses are preferably spaced apart from one another in the width direction of the web 8.

FIG. 2C further shows that in the second position arm of the loading tool extends parallel to the adjacent web portion during printing operations. The respective portion of the web 8 and the arm 131 preferably extend vertically in FIG. 2C. The loading tool 130 is positioned on the remote side of the web 8 with respect to the frame 102. The web 8 between the input roller R1 and the print surface 111 as such extends between the loading tool 130 and the respective side of the frame 102.

In the preferred embodiment in FIG. 2C, the second position of the loading tool 130 is the position wherein the loading tool 130 is positioned during printing operations. In a single pivoting action a new web 8 can then be raised up to the print surface 111 along with the closing the cover 130 formed by the loading tool 130. This simplifies operations for the operator. A detector (not shown), such as a contact switch, may be provided to determine whether the loading tool 130 is in the second position. Only when the detector verifies that the loading tool 130 is properly positioned in the second position will the controller start the printing operation. Thereby, safety is improved.

Figure 3:
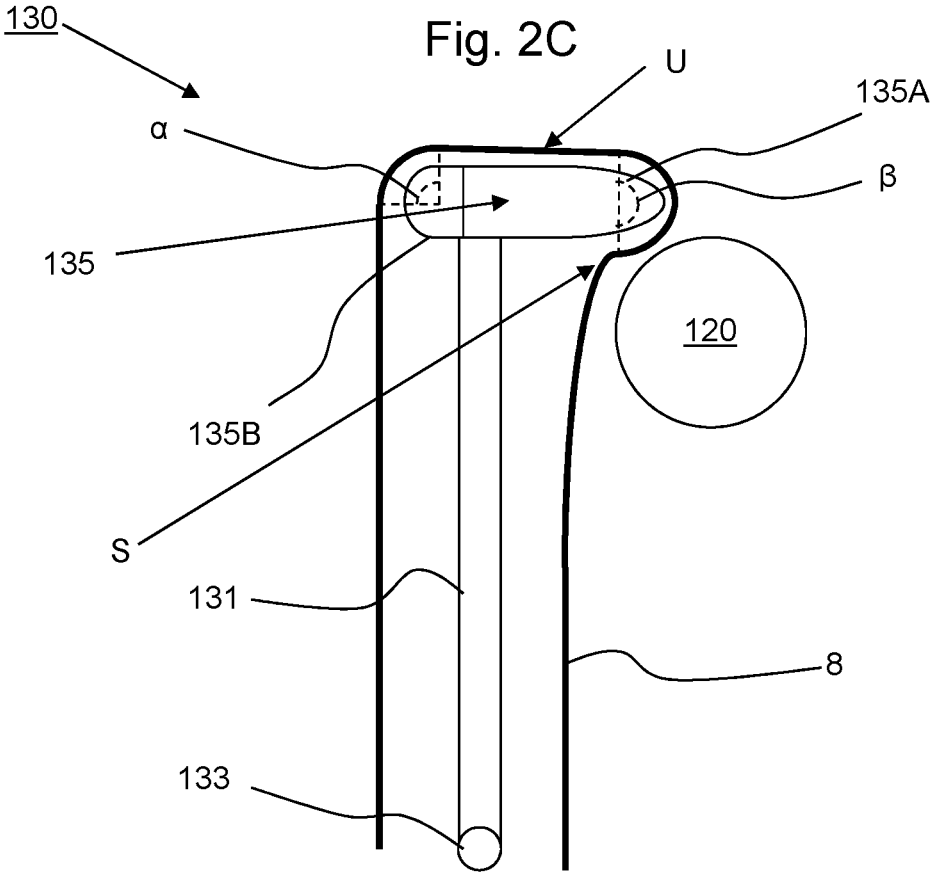
FIG. 3 shows a schematic side view of the loading tool in FIGS. 2A-C.

FIG. 3 shows in more detail the loading tool 130. The web 8 is draped over the beam element 135. The L-shaped free end of the load tool 130 is in the second position positioned adjacent the turn element 120, which element 120 is positioned below the front end of the beam element 135. A small gap or spacing is present between the beam element 135 in the second position and the turn element 120. The beam element 135 of the loading tool 130 comprises two curved sections 135A and 135B. The first curved section 135A extends away from and beyond the arm 131 in the pivoting direction PD. In the second position the first curved section 135A of the end portion 135 is positioned with respect to the turn element 120 to define a half-turn in the web 8. Thereto the first curved section 135A is positioned above the turn element 120 and extends in the pivoting direction PD beyond a side of the turn element 120 facing away from the frame 102. As such, a passage is formed between the turn element 120 and the first curved section 135A, which passage extends partially over the turn element 120. The web 8 in FIG. 3 curves around the first curved section 135A into the passage over an angle β of substantially 180°. This results in a S-shaped curve S in the web 8. A narrow gap exists between the turn element 120 and the first curved section 135A through which gap the web 8 during printing operations moves without contacting the first curved section 135A. During the loading operation, the web 8 contacts the first curved 135A such that the first curved section 135A may exert friction on the web 8 to hold the web 8 in place on the loading tool 130 against gravity acting on the portion of the web 8 between the first curved section 135A and the input roller R1. On the opposite side of the end portion 135 with respect to the first curved section 135A, the web 8 is further curved around the second curved section 135B. At the second curved section 135B, the web 8 under the influence of gravity curves over an angle β of circa 90°. The first curved section 135A in collaboration with the turn element 120 thus defines a turn of roughly 180° (angle α) in the web 8, while the second curved section 135B forms a roughly circa 90° (angle β) in the web 8 under the influence of gravity. The first and second curved sections 135A, 135B preferably have a sufficiently radius of curvature to allow the web to smoothly follow said curvature without wrinkling or folding.

Figure 4:
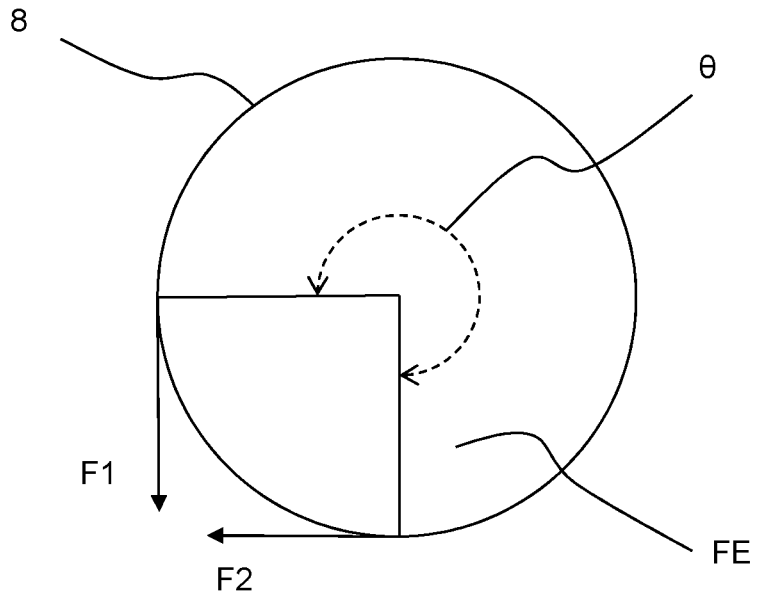
FIG. 4 shows a schematic diagram of the underlying principle applied in the loading tool in FIG. 3.

The curvatures or angles α, β in the web 8 allow the web 8 to be stably held on the loading tool 130, even though the weight (or length) of the portion of the web 8 on one side of the loading tool 130 greatly exceeds that of the weight of the leading edge portion of the web 8 hanging on the other side of the loading tool 130. The general principle behind the invention is explained with respect to FIG. 4. In FIG. 4 a web 8 is curved around a friction element FE in the form of a roller FE. Both ends of the web 8 are pulled by opposing tangential forces F1, F2, which are for example due to gravity acting on the different portions of the web 8. Without friction, any difference between the forces F1, F2 would cause the web 8 to move over the roller FE. In the example in FIG. 4, the web 8 curves over an angle θ, which is roughly 270°. The ratio between the forces F1, F2 wherein the web 8 is held in place by friction is roughly proportional to:

$$\frac{F1}{F2} = e^{\mu\theta}$$

The friction coefficient for paper is generally around 1 and the angle θ is around 270° (or 1.5π), which brings the force ratio to:

$$\frac{F1}{F2} = e^{\mu\theta} \approx 111$$

In consequence, the force F1 may be roughly a hundred times larger than the opposing force F2 (or vice versa) while the web 8 is still stably held in place by friction. With respect to the loading tool 130 in FIG. 3, this means that the leading edge portion of the web 8 may be significantly shorter than the portion of the web 8 between the first curved section 135A and the input roller R1. A shorter web segment is generally easier to handle for an operator. The curvature of the web 8 on the loading tool 8 is defined by the curvature of the first and second curved sections 135A, 135B. The total angle in the embodiment in FIG. 3 formed by the angles α, β comes roughly to 270°, similar to the example in FIG. 4. Hence, 1 cm of web 8 on the remote side of the loading tool 130 should be sufficient to hold 1 m of web 8 on the frame side in place. No clamping is required, which prevents indentations from forming print artifacts on the printed web 8. Further, the loading tool 130 is suited to a wide variety of web media types due to the friction based principle. The loading tool 130 is further relatively simple and low-costs to implement. It will be appreciated that within the present invention different angles α, β may be applied with different ratios or a different total angle. Preferably the sum of the angles α, β is at least 180°.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A web printing system, comprising:

an input roller for supplying a web of print medium along a transport path to a print surface positioned higher than the input roller when in use;

a turn element positioned between the input roller and the print surface, the turn element defining a curve in the transport path;

a loading tool pivotable between a first position for loading a leading edge portion of the web onto the loading tool and a second position, wherein in the second position an end portion of the loading tool extends above the turn element when in use, the loading tool comprising:

an arm pivotably mounted on a frame of the printing system and wherein the end portion of the loading tool comprises a beam element protruding from the arm in a pivoting direction towards the print surface, wherein in the second position the beam element is positioned with respect to the turn element, such that an S-shaped curve is formed in the web held on the loading tool directing a portion of the web underneath the beam element.

2. The web printing system according to claim 1, wherein the end portion is an L-shaped portion configured such that in the second position a leg of the L-shaped portion extends above and at least partially over the turn element.

3. The web printing system according to claim 1, wherein the end portion comprises a first curved section defining an at least semi-circle bend in the web loaded on the loading tool in the second position and a second curved second section positioned opposite to the first curved section in the pivoting direction and defining an at least quarter circle bend in the web loaded on the loading tool in the second position.

4. The web printing system according to claim 3, wherein the first and second curved sections are provided with a high friction surface having a coefficient of friction greater than that of the turn element.

5. The web printing system according to claim 1, wherein the loading tool is positioned on an opposite side of the transport path than the frame.

6. The web printing system according to claim 5, wherein the arm of the loading tool in the second position extends substantially parallel to the adjacent transport path.

7. The web printing system according to claim 6, further comprising:

a closing sensor configured to determine whether the loading tool is in the second position; and a controller to prevent printing when the closing sensor determines the loading tool is absent from the second position.

8. The web printing system according to claim 1, wherein the arm is attached to beam element near or at a side of the beam element facing away from the print surface.

9. The web printing system according to claim 1, wherein the end portion is formed in the second position to collaborate with the turn element to curve the web around the beam element over an angle of substantially at least 180°.

10. The web printing system according to claim 1, wherein the beam element in the second position protrudes such that a portion of the web when positioned on the loading tool curves from a top surface of the beam element around a side of the beam element to underneath the beam element.

11. The web printing system according to claim 1, wherein the beam element is configured such that the web when positioned or draped over the beam element in the second position further comprises a reversed U-shaped curve, wherein legs of the U-shape extend on opposing sides of the beam element.

12. The web printing system according to claim 11, wherein a leg of the U-shape on a side of the frame of the printing system extends into the S-shaped curve.

13. A loading tool for use in the printing system according to claim 1, comprising an arm pivotable around a pivot axis and having an L-shaped end portion comprising a beam element protruding from the arm, the beam element comprising a first curved section for defining an at least semi-circle bend in a web loaded on the loading tool in the second position and a second curved second section positioned opposite to the first curved section defining an at least quarter circle bend in the web loaded on the loading tool in the second position.

14. A method for loading a new web in the web printing system according to claim 1, the method comprising the steps of:

draping a leading edge section of a web over a pivotable loading tool in a first position near an input roller, the loading tool comprising an arm and an L-shaped end portion; and pivoting the loading tool towards a turn element adjacent a print surface to a second position, wherein the end portion is positioned at least partially over the turn element, such that an S-shaped curve is formed in the web between the end portion and the turn element.

15. The method according to claim 14, wherein the step of pivoting comprises the turn element preventing a portion of the web from moving in a pivoting direction as the end portion moves over the turn element in the pivoting direction, thereby forming the S-shaped curve.

16. The web printing system according to claim 1, wherein the end portion is formed in the second position to collaborate with the turn element to curve the web around the beam element over an angle of substantially at least 200°.

17. The web printing system according to claim 1, wherein the end portion is formed in the second position to collaborate with the turn element to curve the web around the beam element over an angle of substantially at least 230°.

18. The web printing system according to claim 1, wherein the end portion is formed in the second position to collaborate with the turn element to curve the web around the beam element over an angle of substantially at least 270°.

* * * * *